United States Patent [19]

Carey

[11] Patent Number: 4,570,145

[45] Date of Patent: Feb. 11, 1986

[54] CONTROL APPARATUS

[76] Inventor: John C. Carey, Box 1143, Glasgow, Mont. 59230

[21] Appl. No.: 631,561

[22] Filed: Jul. 16, 1984

Related U.S. Application Data

[63] Continuation-in-part of Ser. No. 595,549, Mar. 30, 1984, which is a continuation-in-part of Ser. No. 366,042, Apr. 29, 1982, abandoned.

[51] Int. Cl.[4] ..... H01H 61/01; H01H 71/08

[52] U.S. Cl. ..... 337/113; 337/3; 337/381

[58] Field of Search ..... 337/381, 380, 113, 112, 337/3

[56] References Cited

U.S. PATENT DOCUMENTS 3,913,046 10/1975 Davis et al. ..... 337/3

4,091,352 5/1978 Robertson et al. ..... 337/3

*Primary Examiner*—Harold Broome

*Attorney, Agent, or Firm*—Arthur L. Urban

[57] ABSTRACT

Temperature responsive control apparatus includes a body portion, a socket portion, a circuit portion, a connecting portion, a temperature responsive portion and a fastening portion. The body portion includes a housing member including a front face section, a plurality of sidewall sections and a rear section. The socket portion includes a plurality of openings in the front face section with the openings being arranged into groups of at least two adjacent openings with each group providing a combination of openings mateable with an electrical plug member. The circuit portion includes a contact section within the body portion adjacent each socket opening. The connecting portion includes positive and neutral contact terminals disposed on an outer surface of a sidewall or rear section of the body portion with each contact section of one group of socket openings being connected electrically to a different contact terminal. The temperature responsive portion includes a bi-metal thermostat disposed outside the body portion adjacent the rear section thereof with two electrical leads extending from the thermostat. One of the leads has a free end affixed to one of the contact terminals with the other of the contact terminals and a free end of the other of the leads of the thermostat being connectable to an electrical power source. The fastening portion includes flange sections extending from opposite sidewall sections adjacent the front face section.

6 Claims, 4 Drawing Figures

CONTROL APPARATUS

This application is a continuation-in-part of pending application Ser. No. 595,549, filed Mar. 30, 1984, which in turn is a continuation-in-part of copending application Ser. No. 366,042, filed Apr. 29, 1982, now abandoned.

This invention relates to a novel control apparatus and more particularly relates to a new control apparatus for electrical devices.

Society utilizes a wide variety of different electrical devices every day. Some of these devices are operated only on an intermittent basis and normally are activated by a switch of some type. With devices that are inexpensive, activation of the device usually is accomplished with a simple manual switch.

Manual switches on electrical devices and appliances ordinarily are satisfactory when the user must be present during the operation thereof. Examples of such devices include hair dryers, shavers, blenders and the like.

However, with some electrical devices it sometimes is desirable to operate them when no one is present. Examples are ovens, hot water heaters, etc. Such devices normally are equipped with timers or temperature controls that can be set to activate the device when a preselected time or temperature is achieved. However, such controls add significantly to the cost of the item and therefore devices equipped in this way may not even be available to the consumer.

One manually operated electrical device widely used by vehicle owners particularly in cold climates is the engine heater. Such heaters are used in cold weather to maintain the engine and its components at a temperature above ambient temperature. This is done to facilitate starting of the engine when the vehicle has been standing outside in cold weather.

If the engine is not maintained at a temperature above ambient in extremely cold weather, the oil and other fluids in the engine and its accessories may become very viscous. This increase in viscosity of the fluids can make it difficult to move the working parts of the engine and thus the engine cannot be started. A further complication is the fact that the battery cannot deliver electrical energy to the starter as effectively in very cold weather.

To minimize increases in the viscosity of oil and other fluids as the temperature drops, multi-grade oils and fluids have been developed. These formulations are designed to provide a low viscosity, e.g. 10 at low temperatures and a high viscosity, e.g. 40 at higher temperatures. While the use of such multi-grade oils does benefit engine starting at low temperatures, when the temperature drops drastically, it still may not be possible to start an engine.

Because of these winter engine starting problems, engine heaters have become popular in cold weather climates. The heaters are of two general types—plug heaters which are inserted through a plug opening in the engine or tank or hose heaters that are inserted along the length of a water hose of the engine.

In the use of such engine heaters, the vehicle owner connects the heater cord to a power supply such as an electrical circuit of a building. The owner does this when he wishes to start his vehicle engine. However, since it takes some time for the heater to warm the engine, the heater must be activated at a time prior to that when the owner wishes to start the engine.

Selecting the proper time to activate the heater can present problems. If an owner will not use his vehicle until late in the day, he can simply activate the heater a few hours before he wants to start the engine. However, if the owner wishes to use the vehicle early in the morning, he either has to awaken several hours early or he has to activate the heater before he goes to bed the night before. The latter procedure is most common since very few owners are willing to interrupt their sleep just to activate the heater in the middle of the night.

When electrical energy was relatively inexpensive, most people did not mind the small additional energy cost to insure that their vehicle engines would start easily even in very cold weather. However, with the large increases in the cost of electrical energy in recent years, people have become much more conscious of energy conservation and carefully watch their use of energy. As a result, individuals now more fully realize the cost of using an engine heater and are trying to reduce the amount of time that they use the heater.

Whereas persons formerly activated their engine heaters each night during the cold season, now they are monitoring weather forecasts more closely to determine if they can avoid the use of the heater on certain days and nights. While in theory this procedure appears to be an acceptable solution, in practice it leaves much to be desired.

Since it is impossible to predict the weather with certainty, if the vehicle owner does not activate the heater, he is taking a chance that the weather will be much colder than predicted. Should this occur, he may not be able to start his vehicle in the morning when he needs to go to work or take care of some other very important task. On the other hand, if the owner activates the heater and the weather unexpectedly turns warmer than predicted, the owner will have wasted electrical energy in heating the engine when it was not necessary.

From the above discussion, it is evident that engine heaters presently available do not provide a satisfactory solution in many engine heating situations. Thus, there is a need for a control apparatus that can overcome the shortcomings of current heaters as well as other manually operated electrical devices such as fans, space heaters and the like, the operation of which is determined by changes in ambient temperature conditions.

The present invention provides a novel control apparatus for electrical devices. The apparatus of the invention provides a means for overcoming the problems encountered with excess operation of such devices. The control apparatus confines operation thereof to situations in which the device actually is required. The apparatus automatically controls the operation of the device.

The control apparatus of the invention insures that an electrical device does not operate unnecessarily. As a result, the control apparatus minimizes the electrical energy used and thereby significantly reduces the cost of operation and increases the life of the device.

The control apparatus of the present invention is simple in design and relatively inexpensive. The apparatus can be fabricated from commercially available materials and components. Conventional electrical device manufacturing techniques and procedures can be utilized in its fabrication. The apparatus is durable in construction and has a long useful life with a minimum of maintenance.

The control apparatus of the present invention can be installed by persons with limited mechanical aptitude and/or experience. The installation can be completed in a short period of time after a minimum of instruction. The design of the control apparatus eliminates theft problems. A wide variety of different electrical devices can be modified simply and conveniently by most individuals. The apparatus can be employed with a single unit or to control the operation of several devices simultaneously.

These and other benefits and advantages of the novel control apparatus of the present invention will be apparent from the following description and the accompanying drawings in which.

Figure 1:
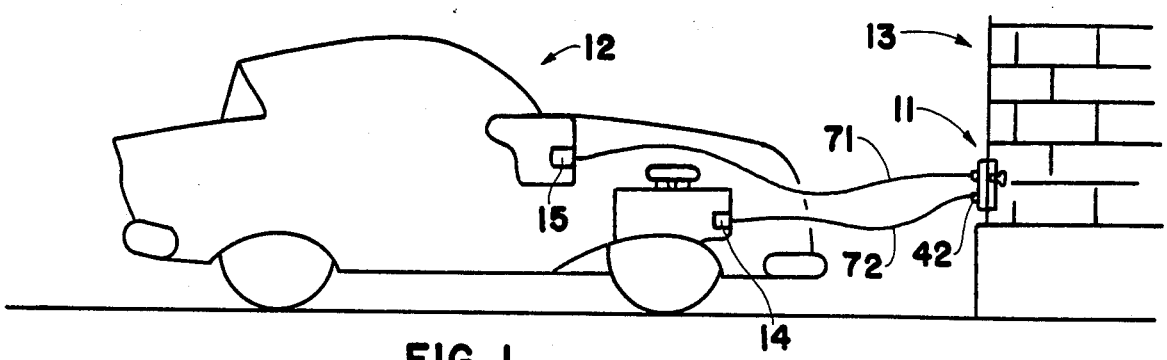
FIG. 1 is a schematic illustration partially in section of one form of temperature responsive control apparatus of the invention in use with vehicle heaters.
Figure 2:
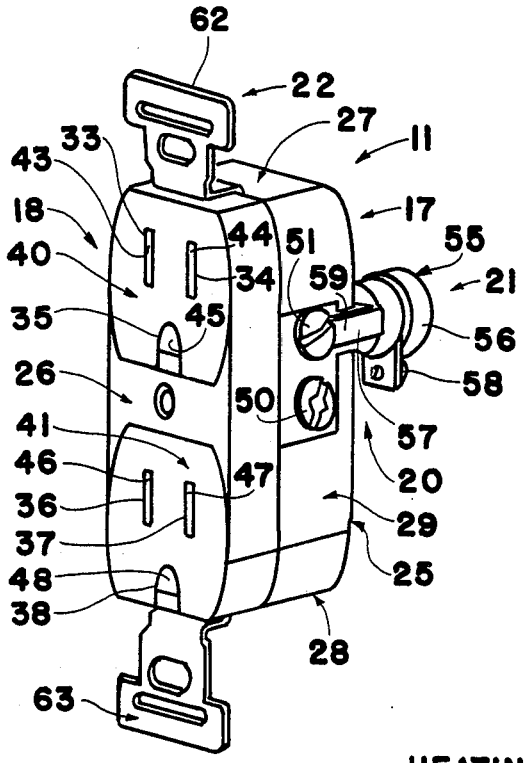
FIG. 2 is an enlarged view in perspective of the temperature responsive control apparatus shown in FIG. 1.
Figure 3:
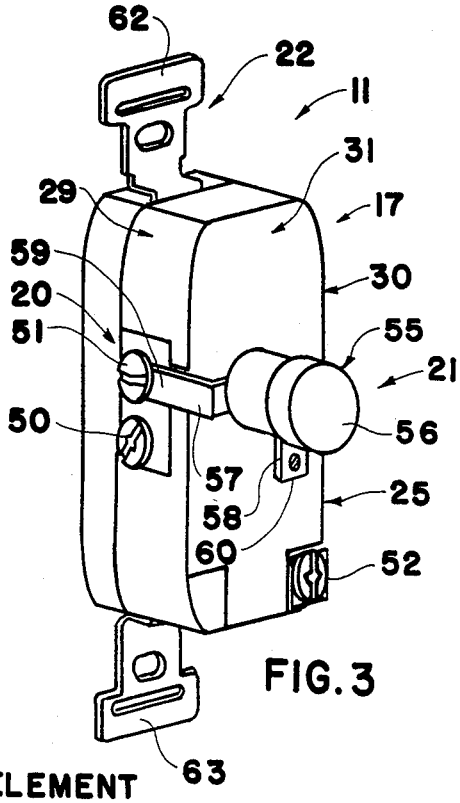
FIG. 3 is a view in perspective from the rear of the temperature responsive control apparatus shown in FIG. 2.
Figure 4:
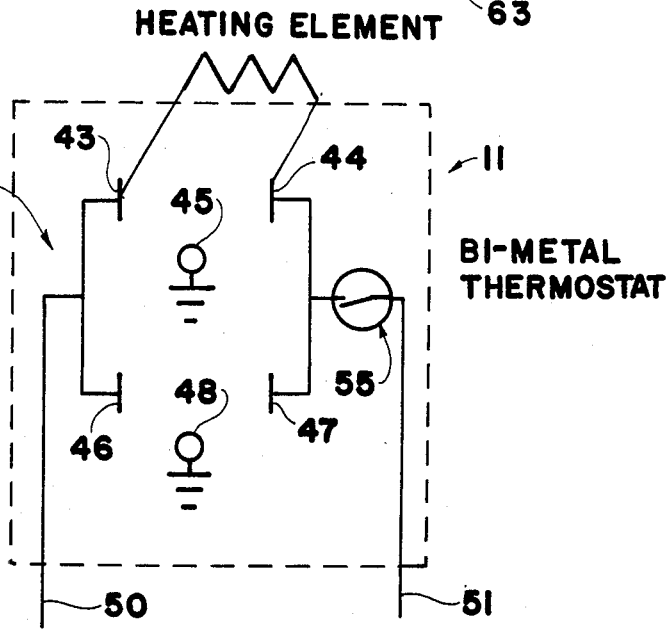
FIG. 4 is a schematic illustration of one form of circuitry of the temperature responsive control apparatus of the invention.

As shown in the drawings, one form of the novel temperature responsive control apparatus 11 of the present invention is shown in use with a vehicle 12. The control apparatus 11 is connected electrically to at least one heating element mounted in the vehicle and to an electrical circuit of a building 13.

The heating element may be an engine heating element 14 such as a plug heater or a passenger compartment heating element 15. The engine heating element 14 may be a commercially available unit commonly employed to heat the engine to facilitate starting thereof in cold weather. The interior heating element 15 also may be a commercially available unit that is utilized to keep the passenger compartment of the vehicle at a comfortable temperature during storage in cold weather so it will not be cold when the driver enters.

The temperature responsive control apparatus 11 of the present invention includes a body portion 17, a socket portion 18, a circuit portion 19, a connecting portion 20, a temperature responsive portion 21 and a fastening portion 22.

The body portion 17 of the control apparatus 11 of the invention includes a housing member 25. The housing member 25 includes a front face section 26 and a plurality of sidewall sections 27, 28, 29 and 30. The sidewall sections 27–30 extend from the edges of the front face section 26. The housing member also includes a rear section 31 that connects opposite edges of the sidewall sections.

Advantageously, the body portion 17 is formed of plastic and preferably is an encapsulating member, that is, the plastic encapsulates circuitry components therein. In a preferred form as shown in the drawings, the body portion has a quadrangular configuration.

The socket portion 18 of the control apparatus 11 includes a plurality of openings 33, 34, 35, 36, 37 and 38 in the front face section 26 of the body portionn 17. The openings 33–38 are arranged into groups 40 and 41 with at least two and advantageously three adjacent cooperating openings, that is, openings 33–35 in group 40 and openings 36–38 in group 41. Each group provides a combination of openings mateable with an electrical plug member 42. The socket openings of each group 40 or 41 preferably are arranged in a triangular configuration.

The circuit portion 19 of the control apparatus 11 includes a contact section 43, 44, 45, 46, 47 and 48 disposed within the body portion 17 adjacent to each socket opening. Advantageously, a ground contact section is disposed adjacent to socket openings 35 and 38.

The connecting portion 20 of the control apparatus 11 of the invention includes positive and neutral contact terminals 50 and 51, respectively. The contact terminals are disposed on an outer surface on a sidewall section 27–30 or of rear section 31 of the body portion. Contact terminals 50 and 51 preferably are located on an outer surface of a sidewall 27 of the body portion.

Each contact section of groups of socket openings is connected electrically to a different contact terminal. Thus, contact section 43 may be connected to terminal 50 while contact section 44 of the same group 40 is connected to terminal 51. Similarly, ground contact 45 is connected to a ground contact terminal 52. In the same way, contact 46 is connected to terminal 50, contact 47 to terminal 51 and ground contact 48 to terminal 52.

The temperature responsive portion 21 of the control apparatus includes bi-metal thermostat means 55. The bi-metal thermostat means 55 is advantageously disposed adjacent the rear section 31 of the body portion. Preferably, the thermostat is disposed in an insulating housing 56.

Two electrical leads 57 and 58 extend from the thermostat 55. One of the leads 57 has a free end 59 affixed to one of the contact terminals, shown as terminal 51. Free end 59 advantageously is separably affixed to the contact terminal 51. The free end 60 of the other lead 58 is connectable to an electrical power source which will be described hereinafter.

The fastening portion 22 of the control apparatus 11 of the invention includes flange sections 62 and 63. The flange sections extend from opposite sidewall sections adjacent the front face section 26 of the body portion. As shown, flange sections 62 and 63 extend from the top and bottom edges of the front face section.

In the use of the control apparatus 11 of the present invention, the apparatus first is installed as a substitute for a commercially available electrical outlet. As shown in the drawings, the control apparatus is located on the outside of a building 13. Lead wires (not shown) from a power source such as the conventional electrical circuitry of a building are affixed to the control apparatus of the invention in the same way as with a conventional outlet fixture. However, instead of the lead wires being connected directly to the contact terminals, one wire is connected to contact terminal 50 and the other wire is affixed to the free end 60 of the thermostat lead 58.

Flange sections 62 and 63 then are secured to a recessed outlet box (not shown) using conventional fasteners and an outlet cover is affixed over the outlet box with the openings in the cover being aligned with the socket groups 40 and 41 of the control apparatus. The control apparatus 11 now is protected against theft and still accessible for use.

In the use of the control apparatus 11, one or more heating elements would have been installed previously in the vehicle 12. An engine heating element 14 can be installed in the engine in the same way as with conventional engine heaters. The heating element may be installed in an engine plug opening or by inserting it along a liquid circulating hose. Also, a passenger compartment heating element 15 can be installed in the vehicle interior. Cords or wires 71 and 72 from the respective heating elements are connected into the socket groups 40 and 41 of the control apparatus 11 which is located outside the vehicle in the ambient atmosphere, yet protected against theft.

The control apparatus 11 automatically heats the vehicle 12 without any attention from the owner. Thus, if the weather turns cold such as a temperature drop at night, the bi-metal thermostat 55 of the control apparatus will close the circuit through the apparatus 11 allowing electrical current to pass from the circuitry of the building 13 to the heating elements 14 and 15. In this way, the vehicle 12 will be heated properly when the owner is ready to use it. The vehicle engine will start easily since it is warm. Also, the interior of the vehicle will be warm for the driver and any passengers.

On the other hand, if the ambient temperature remains at a level in which the vehicle engine will start easily, the bi-metal thermostat 55 of the control apparatus 11 will remain open so that electrical current will not activate the heating elements 14 and 15. Advantageously, the bi-metal thermostat for vehicle heating closes at a temperature between about 0° and 20° F.

Thus, the control apparatus 11 provides heat when the ambient temperature drops below a minimum threshold temperature but does not waste electrical energy to heat the vehicle when it is not necessary. All of this is done automatically without requiring the attention of the owner or other persons.

In addition to the use of the control apparatus 11 in combination with heating elements for vehicles, the control apparatus also can be employed with a wide variety of different electrical devices and appliances that are operated in response to changes in ambient temperatures. Examples of other heaters include space heaters for greenhouses, animal barns, pump houses, incubators, root cellars, etc.; liquid heaters such as livestock watering tanks, heating tapes for water pipes and the like. The control apparatus is useful also with fans such as attic fans, wood stove fans, etc. which circulate warm or hot air. The control apparatus is employed in the manner described above with the operating range of the bi-metal thermostat being selected for the specific temperature conditions to be encountered.

The above description and the accompanying drawings show that the present invention provides a novel control apparatus. The apparatus of the invention minimizes the electrical energy used and thus significantly reduces the operating cost of electrical devices. The apparatus can be used conveniently by persons without mechanical or electrical aptitude.

The control apparatus of the invention is simple in design and can be produced relatively inexpensively. Commercially available materials and components can be used in its fabrication employing conventional electrical manufacturing techniques and procedures.

The control apparatus can be installed easily after only a minimum of instruction. A wide variety of different electrical devices and appliances currently in use can be employed with the apparatus of the invention relatively quickly in only a few minutes. The apparatus can be modified easily to accommodate particular operating temperatures. The apparatus is durable in construction and has a long useful life with little if any maintenance.

It will be apparent that various modifications can be made in the particular control apparatus described in detail and shown in the drawings within the scope of the invention. The size, configuration and arrangement of components can be different to meet specific requirements. Also, the apparatus can be designed to accommodate electrical devices operating at particular temperature ranges as desired. These and other changes can be made provided the functioning and operation of the control apparatus are not adversely affected. Therefore, the scope of the invention is to be limited only by the following claims.

I claim:

1. Temperature responsive control apparatus including a body portion, a socket portion, a circuit portion, a connecting portion, a temperature responsive portion and a fastening portion; said body portion including a plastic housing member, said housing member including a front face section, a plurality of sidewall sections extending from edges of said front face section and a rear section connecting opposite edges of said sidewall sections, said body portion being an encapsulating member; said socket portion including a plurality of openings in said front face section, said openings being arranged into groups of at least two adjacent openings with each group providing a combination of openings mateable with an electrical plug member; said circuit portion including a contact section within said body portion adjacent each socket opening; said connecting portion including positive and neutral contact terminals disposed on an outer surface of a sidewall or rear section of said body portion, each contact section of one group of socket openings being connected electrically to a different contact terminal, said contact terminals being located on an outer surface of one rear or sidewall of said body portion; said temperature responsive portion including bi-metal thermostat means, said thermostat means being disposed outside said body portion adjacent said rear section thereof, said bi-metal thermostat means including an insulating housing, two electrical leads extending from said thermostat means, one of said leads having a free end affixed to one of said contact terminals, the other of said contact terminals and a free end of the other of said leads of said thermostat means being connectable to an electrical power source; said fastening portion including flange sections extending from opposite sidewall sections adjacent said front face section, each flange section including at least one opening therethrough; whereby electrical current only moves through said control apparatus to energize electrical devices having plug members inserted into said socket portion when a threshold temperature of said bi-metal thermostat means is passed.

2. Temperature responsive control apparatus according to claim 1 wherein said body portiion has a quadrangular configuration.

3. Temperature responsive control apparatus according to claim 1 wherein each group of socket openings includes three socket openings.

4. Temperature responsive control apparatus according to claim 3 wherein said three socket openings are arranged in a triangular configuration.

5. Temperature responsive control apparatus according to claim 3 wherein a ground contact is disposed adjacent one of said socket openings.

6. Temperature responsive control apparatus according to claim 1 wherein said one lead of said bi-metal thermostat means is separably affixed to said contact terminal.

* * * * *